United States Patent [19]

Oyama et al.

[11] Patent Number: 4,561,403

[45] Date of Patent: Dec. 31, 1985

[54] AIR-FUEL RATIO CONTROL APPARATUS FOR INTERNAL COMBUSTION ENGINES

[75] Inventors: Yoshishige Oyama, Katsuta; Mamoru Fujieda, Ibaraki; Teruo Yamauchi, Katsuta, all of Japan

[73] Assignee: Hitachi, Ltd., Tokyo, Japan

[21] Appl. No.: 643,292

[22] Filed: Aug. 22, 1984

[30] Foreign Application Priority Data

Aug. 24, 1983 [JP] Japan ..... 58-153203

[51] Int. Cl.[4] ..... F02D 5/00

[52] U.S. Cl. ..... 123/489; 123/492

[58] Field of Search ..... 123/489, 440, 589, 492, 123/480

[56] References Cited

U.S. PATENT DOCUMENTS

| | | | |
|---|---|---|---|
| 4,088,095 | 5/1978 | Aono | 123/489 |
| 4,109,615 | 8/1978 | Asano | 123/440 |
| 4,140,085 | 2/1979 | Rabus et al. | 123/489 |
| 4,214,306 | 7/1980 | Kobayashi | 123/492 |
| 4,245,605 | 1/1981 | Rice et al. | 123/480 |
| 4,290,107 | 9/1981 | Suda et al. | 123/440 |
| 4,319,451 | 3/1982 | Tajima et al. | 123/489 |
| 4,359,993 | 11/1982 | Carlson | 123/492 |
| 4,398,514 | 8/1983 | Nakamura | 123/440 |
| 4,434,768 | 3/1984 | Ninomiya | 123/489 |
| 4,483,301 | 11/1984 | Yamada et al. | 123/489 |

FOREIGN PATENT DOCUMENTS 58-41231 3/1983 Japan .

*Primary Examiner*—Andrew M. Dolinar

*Attorney, Agent, or Firm*—Antonelli, Terry & Wands

[57] ABSTRACT

A control apparatus includes an air-fuel ratio sensor for detecting an oxygen content over a wide range of operating conditions from a light load operation to a high load operation of an engine and the sensor is utilized so as to establish the desired air-fuel ratio such that the air-fuel ratio ($\lambda$) becomes $\lambda>1$, $\lambda=1$ or $\lambda<1$, respectively in the light, intermediate or high load operating region of the engine and the output of the air-fuel ratio sensor is utilized so as to feedback control the air-fuel ratio over the wide range of operating conditions and thereby maintain the desired air-fuel ratio in each of the operating regions.

14 Claims, 29 Drawing Figures

AIR-FUEL RATIO CONTROL APPARATUS FOR INTERNAL COMBUSTION ENGINES

The present invention relates to an air-fuel ratio control apparatus for internal combustion engines, especially automobile engines.

Conventional air-fuel ratio control methods for fuel supply systems of automobiles are designed so that, as disclosed for example in Japanese Laid-Open Patent Application No. 58--41231, the air-fuel ratio is controlled in such a manner that the air-fuel ratio is increased to improve the fuel consumption at a light load (the intake pipe pressure is low), that the air-fuel ratio is feedback controlled at a stoichiometric ratio so as to ensure the desired drivability at an intermediate load and that the air-fuel ratio is decreased to ensure the desired power output at a high load (the intake pipe pressure is high).

However, such preset control of the air-fuel ratio is effected by computing a fuel correction amount in accordance with the intake pipe pressure and decreasing or increasing the basic fuel injection quantity in accordance with the computed value. As a result, excepting the control at the intermediate load, these controls are open-loop controls and it is foreseen that at the light load the air-fuel ratio becomes excessively large causing the engine to misfire and at the high load the air-fuel ratio becomes excessively small increasing the amount of CO emission due to the accuracy and aging of the sensors and actuators. Thus, the air-fuel ratio is controlled to become rather small at the light load and rather large at the high load and this practice is still inadequate to produce a desired effect.

It is therefore an object of the present invention to provide an air-fuel ratio control apparatus for internal combustion engines which overcomes the foregoing deficiencies of the prior art apparatus and ensures a reduced fuel consumption under low load conditions and a high power output under high load conditions.

In accordance with the invention, the above object is accomplished by feedback controlling the air-fuel ratio of an engine over a wide range of operating conditions.

The above and other objects, features and advantages of the present invention will be apparent from the following detailed description of the preferred embodiments of the present invention in connection with the accompanying drawings, in which.

Figure 24:
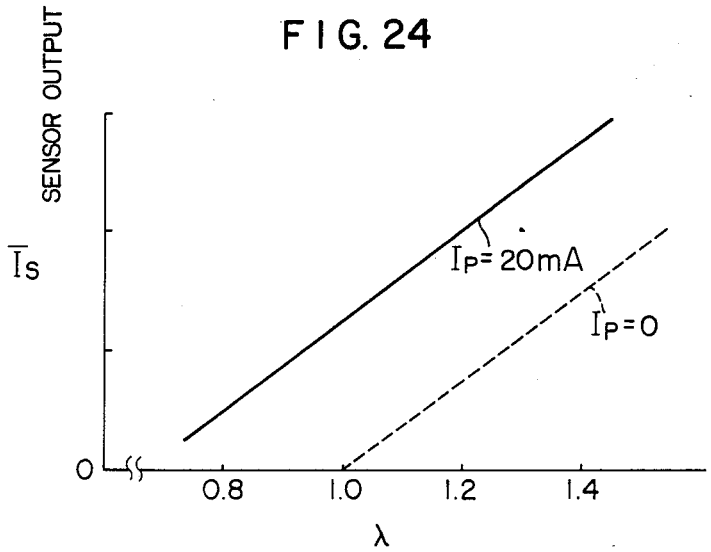
Figure 22:
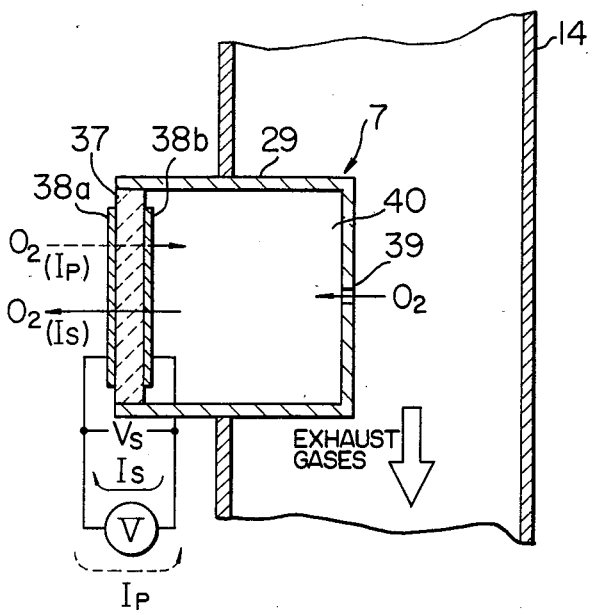
FIG. 22 is a schematic sectional view showing the construction of an air-fuel ratio sensor capable of measuring the oxygen content over a wide range of operating conditions from the light load to the high load operation.
Figure 23A:
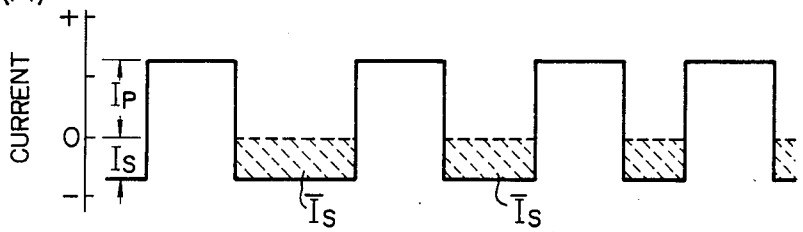
Figure 23B:
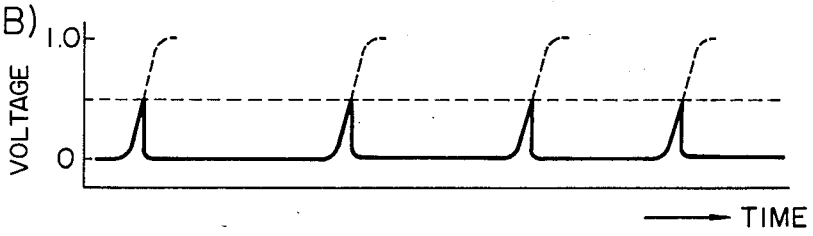
Figure 25A:
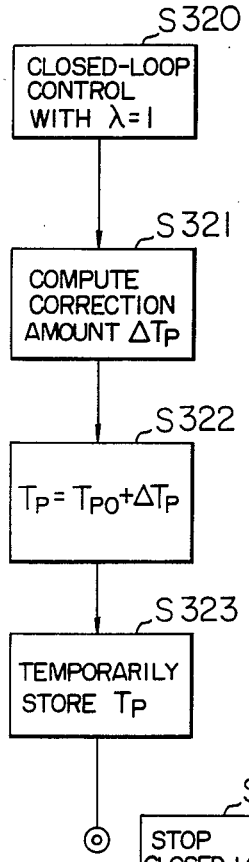
Figure 25B:
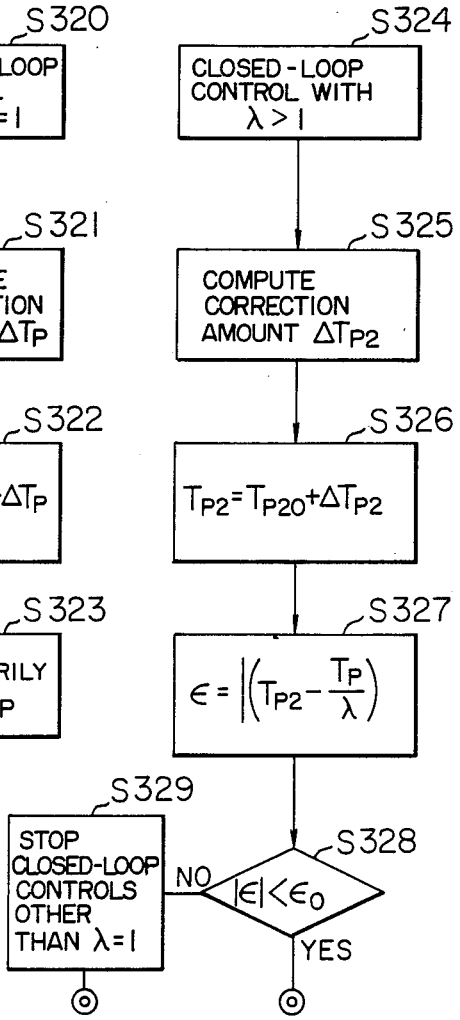
Figure 26A:
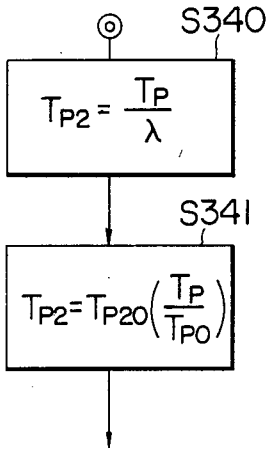
Figure 26B:
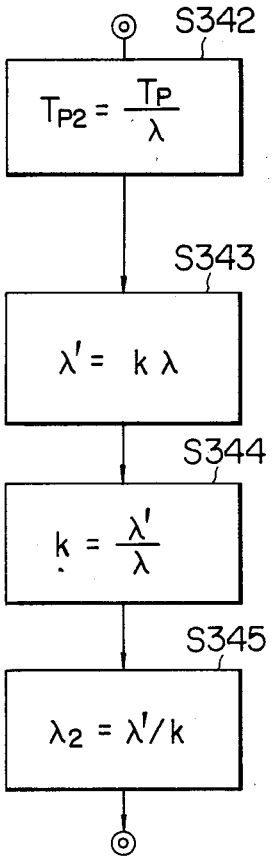

FIGS. 23(A) and 23(B) show waveforms useful for explaining the operation of the air-fuel ratio sensor shown in FIG. 22;

FIG. 24 is a graph showing the output characteristics of the air-fuel ratio sensor shown in FIG. 22; and FIGS. 25(A), 25(B), 26(A) and 26(B) are flow charts showing the operation of controlling the air-fuel ratio by correcting the changes in characteristics with time of the air-fuel ratio sensor shown in FIG. 22.

Figure 1:
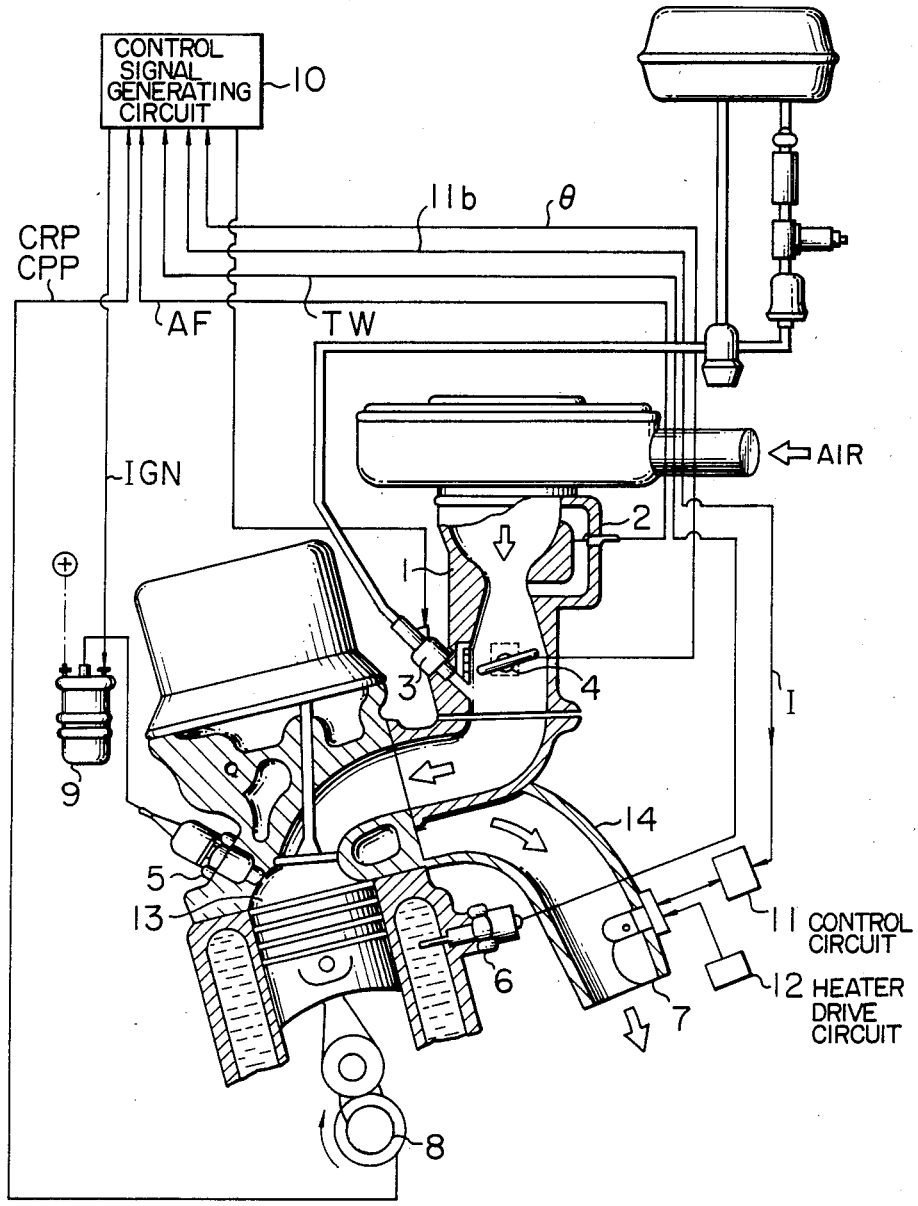
FIG. 1 is a schematic diagram showing the construction of an embodiment of the invention.

FIG. 1 is a schematic diagram showing the construction of an embodiment of an automobile engine control system to which the present invention is applied. In the Figure, numeral 1 designates a throttle chamber, 2 a hotwire intake air flow sensor, 3 an injection valve, 4 a throttle actuator, 5 a spark plug, 6 a water temperature sensor, 7 an air-fuel ratio sensor, 8 a crank-angle sensor, 9 an ignition coil, 10 a control signal generating circuit including a microcomputer, 11 a control circuit for the air-fuel ratio sensor 7, 12 a heater drive circuit, and 13 a combustion chamber. This control system performs its air-fuel ratio control by detecting the air-fuel ratio by the air-fuel ratio sensor 7 capable of detecting the air-fuel ratio over a wide range from a rich region ($\lambda<1$) to a lean region ($\lambda>1$). In other words, when the control signal generating circuit 10 determines the desired air-fuel ratio to be controlled in accordance with the engine speed, load, water temperature, etc., the required control signals are applied to the injection valve 3 and the throttle actuator 4 and a closed-loop control is performed in accordance with a feedback signal indicative of the intake air flow detected by the intake air flow sensor 2. The mixture formed in the throttle chamber 1 is introduced into the combustion chamber 13 where the mixture is ignited by the spark plug 5 and then it flows to an exhaust gas exhaust pipe 14. In this case, the actual air-fuel ratio is detected by the air-fuel ratio sensor 7 and its output signal is applied to the control signal generating circuit 10 thereby performing the close-looped control. It is to be noted that the heater drive circuit 12 is provided because the air-fuel ratio sensor 7 must be heated to an elevated temperature in view of the characteristics of the solid electrolyte used by the air-fuel ratio sensor 7.

Figure 2:
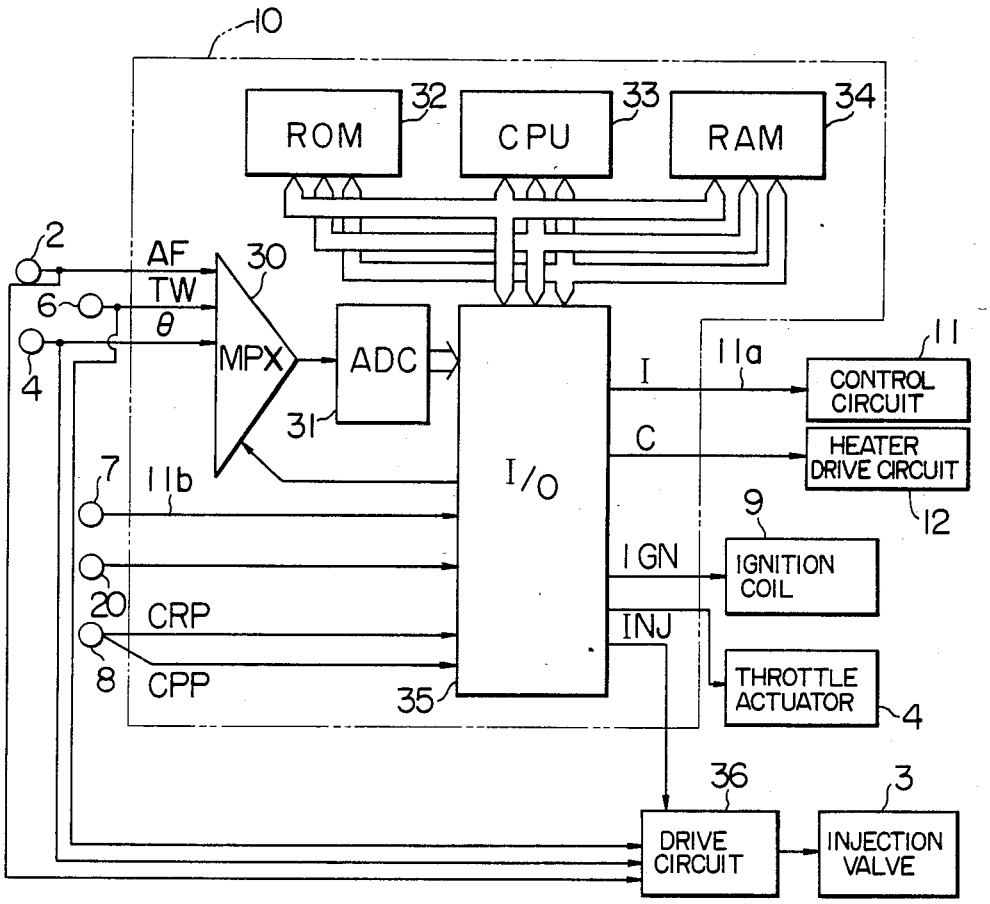
FIG. 2 is a block circuit diagram showing in detail the control signal generating circuit in the embodiment of FIG. 1.

FIG. 2 is a detailed block diagram of the control signal generating circuit 10. The analog input signals to the circuit include the air flow signal AF from the hot-wire intake air flow sensor 2, the water temperature signal TW from the water temperature sensor 6 and the throttle opening signal from the throttle actuator 4 and these signals are applied to a multiplexer 30 which in turn selects and supplies the signals in a time-shared manner to an A-D converter 31 where the signals are converted to digital signals. Also, the information applied as ON/OFF signals include the signal 11*b* from the control circuit 11 of the air fuel ratio sensor 7, etc., and these signals are handled as 1-bit digital signals. In addition, the pulse train signals CRP and CPP from the crank angle sensor 8 are also applied. Numeral 32 designates an ROM, and 33 a CPU. The CPU 33 is a processing central unit for performing digital computational operations and the ROM 32 is a memory device for storing control programs and fixed data. An RAM 34 is a read/write memory device. An I/0 circuit 35 serves the function of sending the signals from the A-D converter 31 and the sensors to the CPU 33, sending the signals from the CPU 33 to a drive circuit 36 of the injection valve 3, the throttle actuator 4, the ignition coil 9 and the heater drive circuit 12 of the air-fuel ratio sensor 7 and sending a control signal 11*a* to the control circuit 11. Numeral 20 designates a sensor responsive to the position of the transmission gear to generate a signal.

With this system, the fuel is supplied intermittently in synchronism with the intake stroke of the engine and therefore a basic injection time $T_a$ is given as follows $$T_a = Q_a/N \quad (1)$$

where $Q_a$ represents the amount of air detected by the air flow signal AF and N represents the engine speed. It is the usual practice to select the value of the basic injection time $T_a$ so that $\lambda = 1$ and this system sets the value in the same ways.

Figure 3:
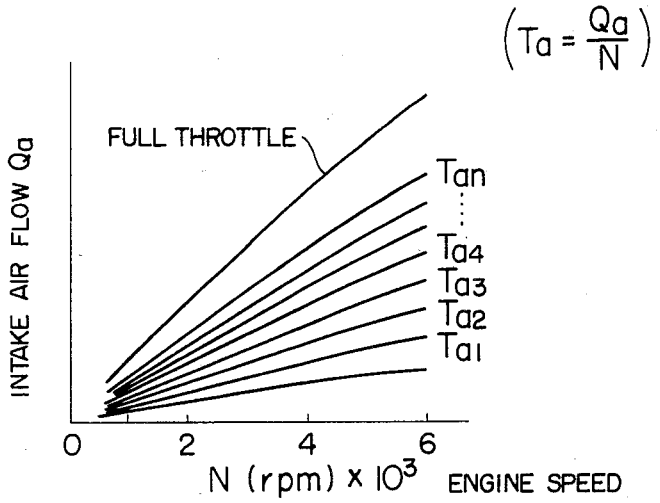
FIG. 3 is a graph showing the relation between the engine speed N and the intake air amount.

FIG. 3 is a graph showing the relation of the basic injection quantity $T_a$ which is determined by the engine speed N and the air amount $Q_a$ in this sytem.

Figure 4:
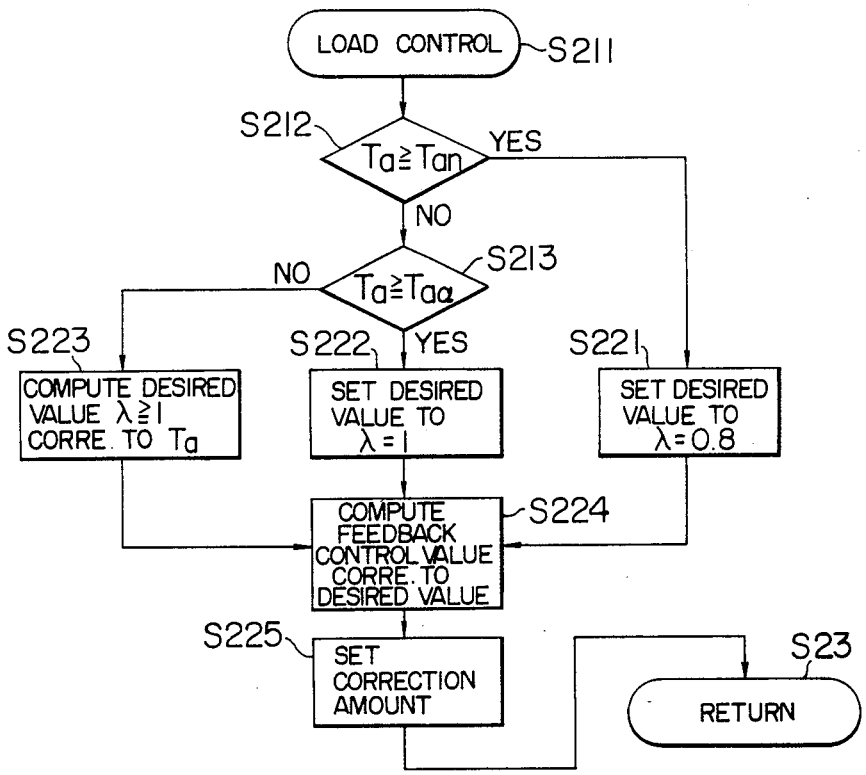
FIG. 4 is a flow chart showing the air-fuel ratio controlling operation of the embodiment of the invention.

FIG. 4 is a part of a flow chart of the microcomputer showing the air-fuel ratio control method in the embodiment of the invention. It is to be noted that in FIG. 4 the processing from an interrupt routine entry up to the calculation of a basic injection quantity $T_a$ is omitted and it is simply represented as a "load control" step. In the Figure, at a step S212, a decision is made as to $T_a \geqq T_{an}$ so that if it is, a transfer is made to a step S221 where the desired value of the closed-loop control is set to $\lambda = 0.8$. Then, after the deviation value of the actual measured value from the set value has been calculated at a step S224, a correction amount is set at a step S224 and then a return is made to the main routine at a step S23. If the result of the decision at the step S212 is NO, a transfer is made to a step S213 where a decision is made as to $T_a \geqq T_{a\alpha}$. If the decision results in YES, a transfer is made to the next step S222 so that the desired value of the closed-loop control is set to $\lambda = 1$ and the processing advances through the steps S224 and S225 thereby returning to the main routine at the step S23. On the other hand, if the decision as to $T_a \geqq T_{a\alpha}$ is NO, a transfer is made to a step S223 so that the desired value of $\lambda \geqq 1$ corresponding to the basic injection quantity Ta is calculated (this calculation is well-known in the art) and the result of the calculation is used as the desired value of the closed-loop control thereby effecting the closed-loop control and making a return to the main routine at the step S23.

Figure 5:
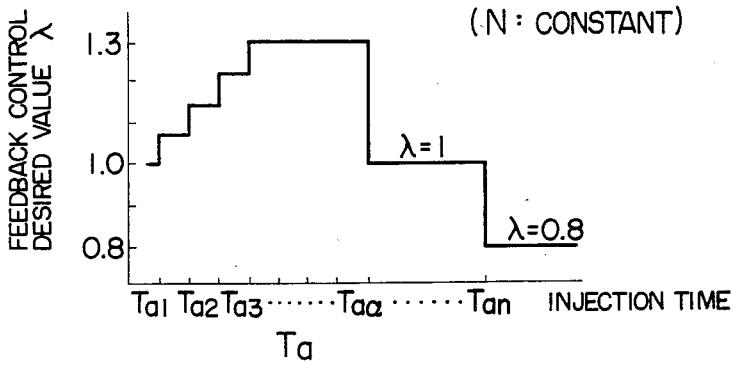
FIG. 5 is a graph showing the relation between the fuel injection time and the desired value λ.

FIG. 5 is a graph showing the relation between the basic injection time $T_a$ of FIG. 4 and the desired value $\lambda$ of the feedback control. In the Figure, the value of $T_a$ is substantially proportional to the intake pipe pressure so far as the engine speed N is constant. As a result, the desired value of the open-loop control is set in such a manner that $\lambda = 0.8$ is set when the value of the injection time $T_a$ a is large or $T_a \geqq T_{an}$, that $\lambda = 1.0$ is set for the range of $T_a < T_a \geqq T_{an}$ and that the value of $\lambda > 1$ corresponding to the value of $T_a$ is set for the range of $T_a \geqq T_{a\alpha}$.

Figure 6:
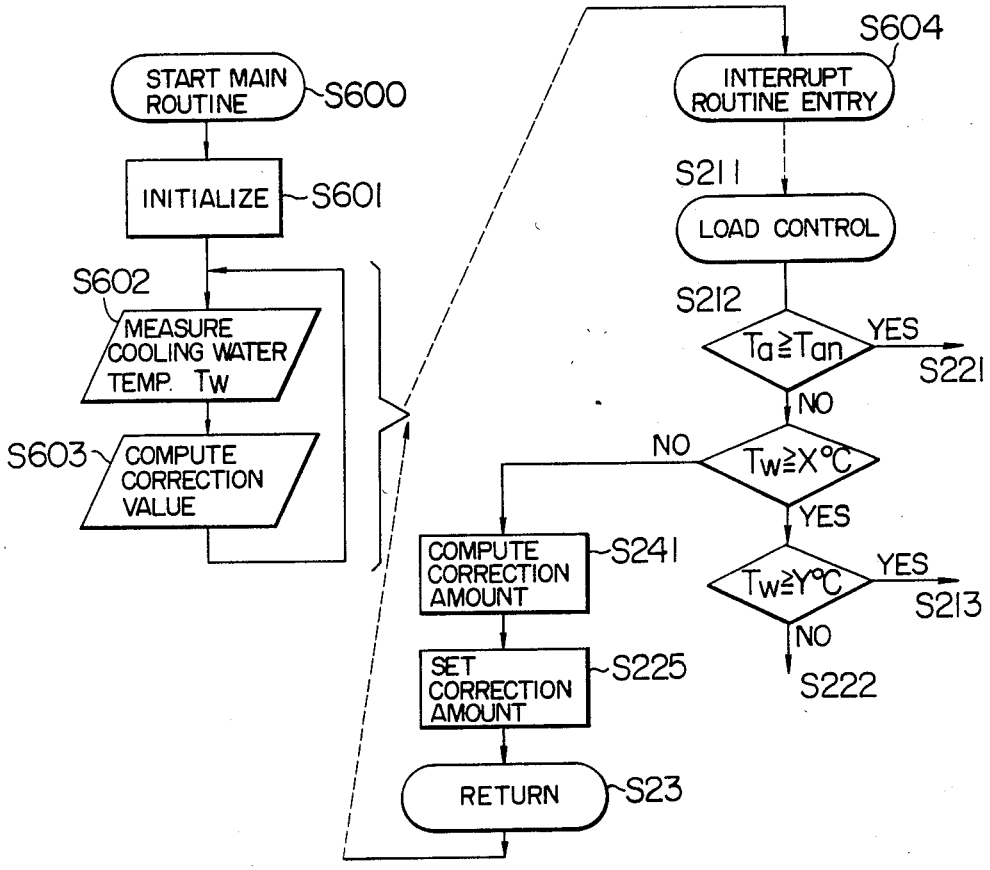
FIG. 6 is a flow chart showing the operation of controlling the air-fuel ratio of the engine during the starting period.

Next, the method of the embodiment of the invention for controlling the air-fuel ratio of the engine during the starting and warm-up period will be described with reference to the flow chart of FIG. 6. Immediately after the starting of the engine, the main routine is started so that an initialization is performed at a step S601. At the next step S602, the cooling water temperature $T_w$ is measured. Then, at a step S603, a correction amount is computed in accordance with the value of $T_w$ and it is superposed on the basic injection quantity $T_a$. During the calculation of this correction amount, the interrupt routine of a step S604 is started and the air-fuel ratio is controlled suitably in accordance with the engine load. In other words, in the load control flow chart of the interrupt routine S604, if $T_a \geqq T_{a\alpha}$, the processing proceeds to the step S221 where the desired value of the closed-loop control is immediately set to $\lambda = 0.8$ and the negative feedback control is performed. If $T_a < T_{a\alpha}$ (when the load is not high), the water temperature $T_w$ is also taken into consideration so that if the water temperature $T_w$ is lower than a predetermined value X° C., the value of $\lambda$ is decreased as shown by the broken line in FIG. 6, that is, the mixture is enriched and the combustion is stabilized.

Then, if $T_w \geqq$ X° C., the value of $T_w$ is compared with a higher preset water temperature value Y° C. so that if $T_w \geqq$ Y° C., then the control is effected along the flow of the step S213 in the flow chart of FIG. 4. If $T_w <$ Y° C., then the control is effected in accordance with the flow chart along the flow of the step S222.

Next, the method of controlling the air-fuel ratio during the transitional operation will be described.

Figure 7:
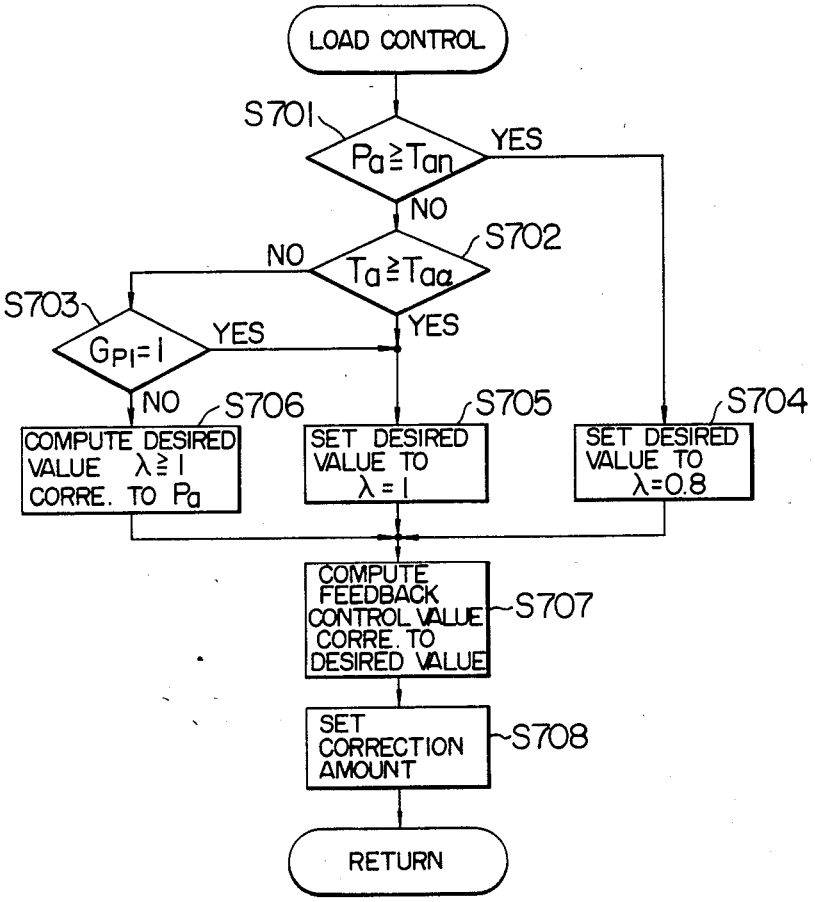
FIG. 7 is a flow chart showing the operation of controlling the air-fuel ratio in accordance with the position of the transmission gear.

FIG. 7 shows a flow chart for changing the mixture control method in accordance with the position of the transmission gear. More specifically, at a step S701, the engine load condition is detected in accordance with the intake negative pressure $P_a$ so that if $P_a \geqq T_{an}$, then the negative feedback control setting the desired value of the air-fuel ratio $\lambda$ to 0.8 is immediately started. On the other hand, when the engine load decision results in $P_a < T_{an}$ indicating the part load condition (e.g., when the throttle valve is at an intermediate position which is short of the fuel throttle position), in a range of values of the injection time $T_a$ on both sides of the certain predetermined value $T_{a\alpha}$ (used for determining the proportion of the load), the desired value of the predetermined airfuel ratio is controlled at $\lambda=1$ or the desired value is controlled at $\lambda \geqq 1$ in accordance with the load $P_a$ (the intake negative pressure). Thus, after the value of $T_a$ has been descriminated with respect to the value of $T_{a\alpha}$, the gear position detecting sensor 20 (FIG. 2) is utilized so that if the gear position is the first speed, the injection duration is immediately controlled to attain the desired value of the air-fuel ratio of $\lambda=1$. If the gear position is not the first speed, the control is effected to attain the desired value of $\lambda \geqq 1$ corresponding to the intake negative pressure $P_a$ in the usual manner.

Figure 8:
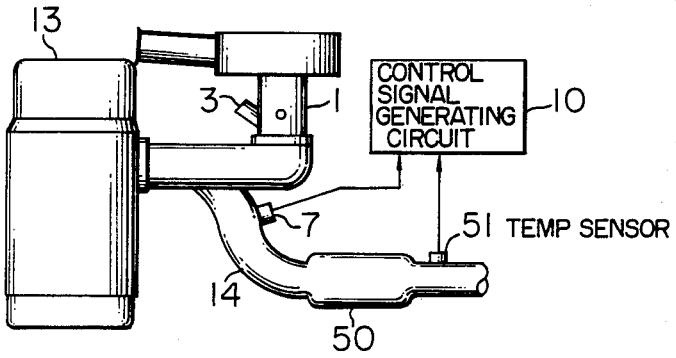
FIG. 8 is a schematic diagram showing the mounting position of a sensor for detecting the exhaust gas temperature.
Figure 9:
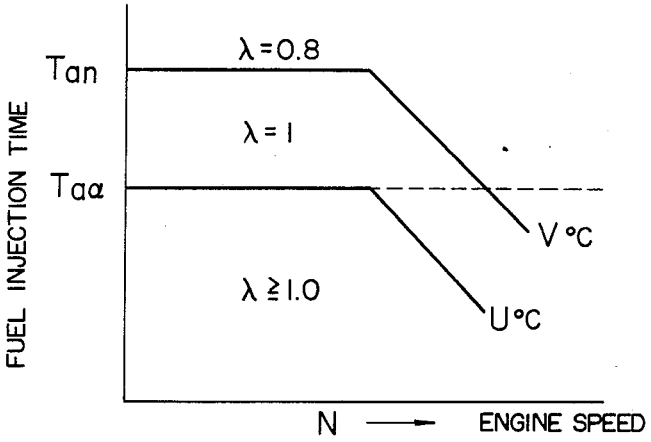
FIG. 9 is a graph showing the relation between the engine speed N and the fuel injection time Ta.
Figure 10:
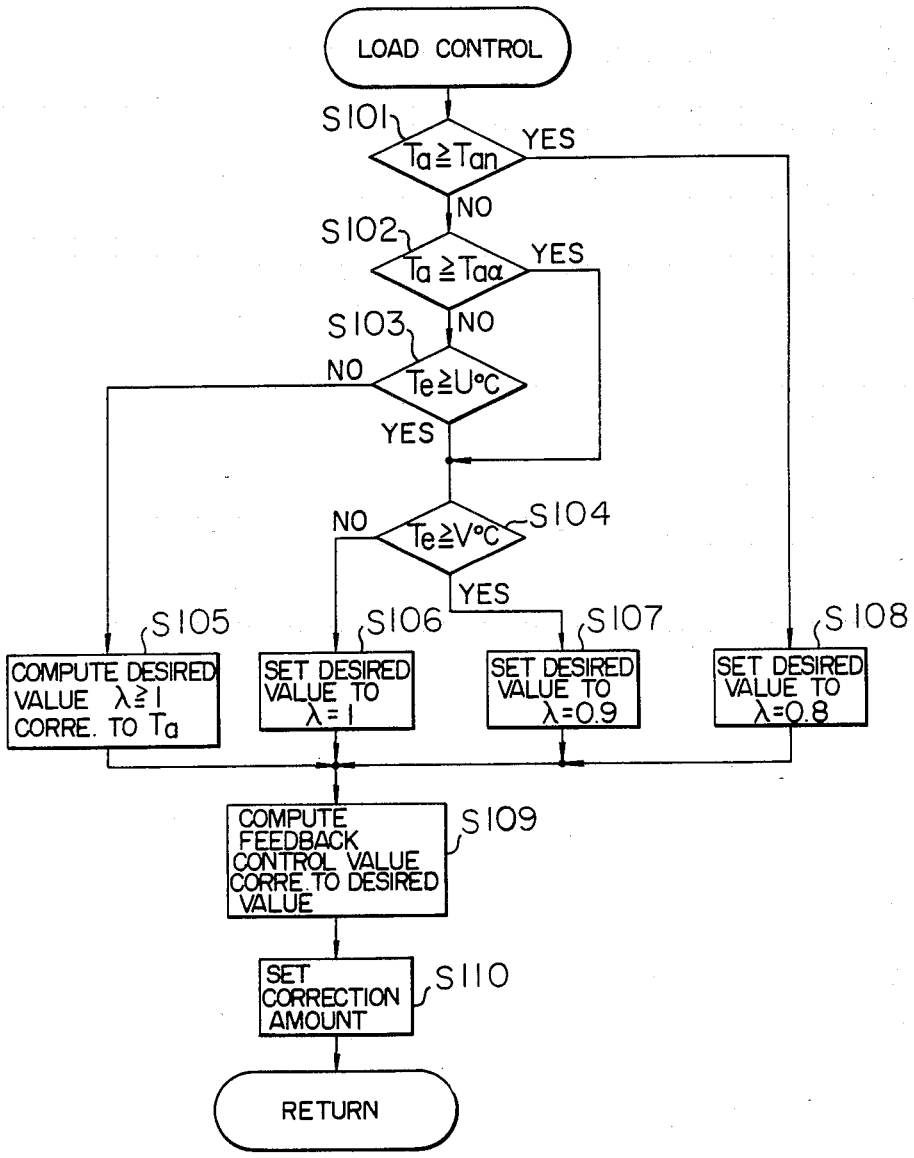
FIG. 10 is a flow chart showing the operation of controlling the air-fuel ratio in accordance with the exhaust gas temperature.

Referring now to the embodiment shown in FIGS. 8 to 10, a specific method will be described as a means of preventing the exhaust gas temperature from rising during the engine operation and producing detrimental effects on the engine and the peripheral devices. In FIGS. 8 to 10, the fuel injected from the injection valve 3 downstream of the throttle chamber 1 is introduced into the combustion chamber 13 where the fuel is burned and it is then discharged through the exhaust pipe 14. The output signals from the air-fuel sensor 7 and a temperature sensor 51 disposed downstream of a catalytic converter 50 are supplied to the microcomputer 10. In this way, the exhaust gas temperature is always monitored so that as the engine speed N is increased, the desired value of the air-fuel ratio $\lambda$ is changed depending on the magnitude of the exhaust gas temperature $T_e$ relative to two preset exhaust gas temperatures, i.e., a lower temperature U° C. and a higher temperature V° C. as shown in the graph of FIG. 9. More specifically, the desired value is set to $\lambda=0.8$ under the high load conditions of $T_a \geqq T_{a\alpha}$ and the control is effected according to $\lambda=1.0$ under the conditions of $T_a<T_{a\alpha}$. When the exhaust gas temperature $T_e$ is lower than U° C., the variation of the catalyst is small and thus the injection time $T_a$ of the injection valves is controlled in accordance with the desired value of $\lambda \geqq 1$ corresponding to the value of $T_a$. In FIG. 10, the relative magnitude of the injection time $T_a$ is detected at steps S101 and S102 and the relative magnitude of the exhaust gas temperature $T_e$ is detected at steps S103 and S104. Then, the desired value $\lambda$ is set to the proper values in accordance with these relative values at steps S105 to S108. The air-fuel ratio control of FIG. 10 is effective in protecting the exhaust gas purification catalyst.

Figure 11:
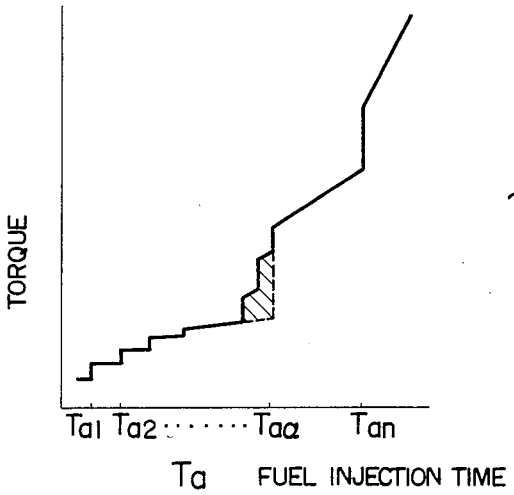
FIGS. 11 and 12 are graphs showing respectively the relation between the fuel injection time and the engine torque and the relation between the fuel injection time and the desired value λ.
Figure 12:
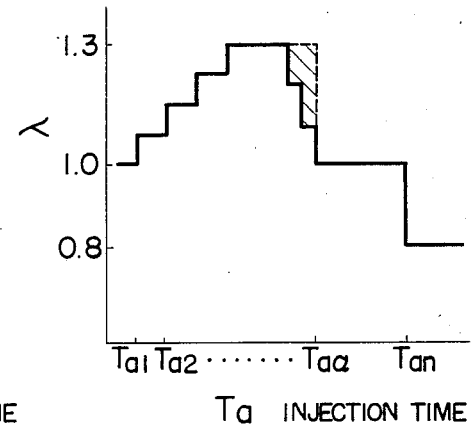

Next, the method of controlling the air-fuel ratio during the acceleration/deceleration operation will be described. FIG. 11 shows the variation of the engine torque with the basic injection time $T_a$. In the Figure, when the value of $T_a$ is small, $\lambda \geqq 1$ so that a lean mixture is supplied and the rise of the torque is small. On the other hand, where $T_a \geqq T_{a\alpha}$, $\lambda=1$ so that the generated torque rises rapidly as shown by the dotted line and a feeling of shock is caused on the part of the driver. As a result, the drivability can be improved by increasing the torque in a stepwise manner as shown by the hatched region in FIG. 11. Thus, in the case of the deceleration, a feeling of shock on the part of the driver, etc., can be similarly prevented by decreasing in steps the desired value $\lambda$ of the air-fuel ratio control with respect to the basic injection time (injection quantity) $T_a$ as shown by the hatched region in the graph of FIG. 12.

Figure 13:
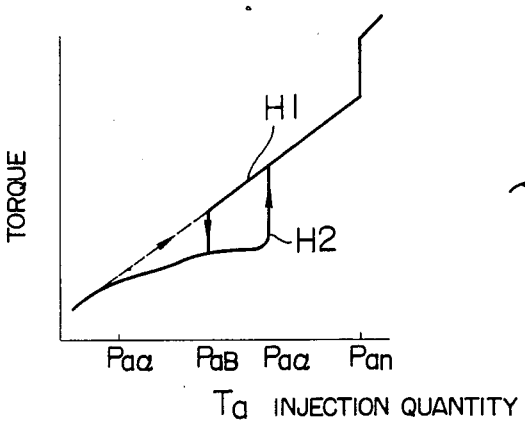
FIGS. 13 and 14 are graphs showing respectively the relation between the fuel injection quantity and the engine torque and the relation between the injection quantity and the desired value λ.
Figure 14:
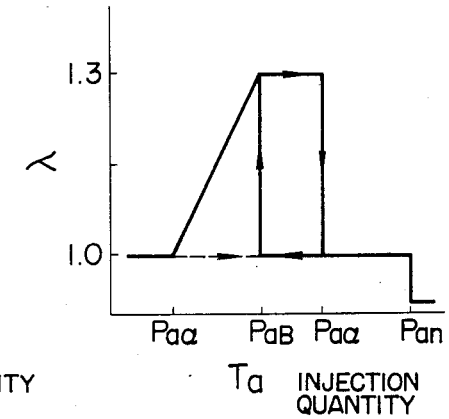
Figure 15:
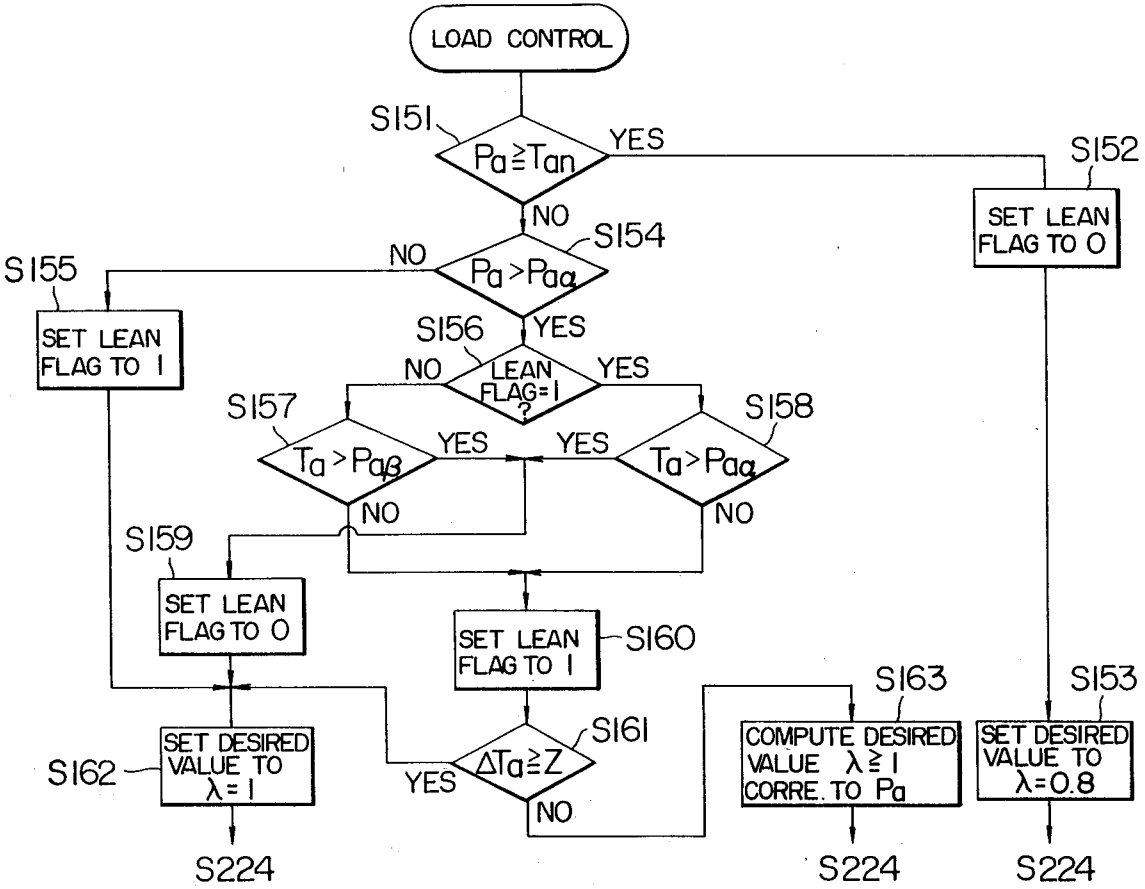
FIG. 15 is a flow chart for explaining the operation of controlling the air-fuel ratio by utilizing the hysteresis of the engine torque.

Also, the variation of the torque with the value of $T_a$ may be provided with a hysteresis as shown in FIG. 13. Such a hysteresis can be obtained by controlling the desired value $\lambda$ as shown in FIG. 15. In this case, the setting of $\lambda$ relative to the value of $T_a$ becomes as shown in FIG. 14. A specific flow chart for this case is shown in FIG. 15. In this flow chart, the condition of the hysteresis is discriminated by means of a lean flag.

When it is detected at steps S151 and S154 that the injection quantity $T_a$ is in the range between $T_{an}$ and $T_{a\alpha}$, the lean flag is set to 1 at a step S155 and the desired value $\lambda$ is set to 1.0 at a step S162. On the other hand, if the injection quantity $T_a$ is smaller than $T_{a\alpha}$, whether the lean flag is 1 is determined at a step S156. The purpose of this decision is to detect whether the variation of the torque is a high-to-low variation, that is, whether the torque variation is in the direction shown by the arrow H1 in FIG. 13. Thus, a transfer is made to a step S157 if the torque variation is the curve H1 and a transfer is made to a step S157 if the torque variation is the curve H2. At a step S161, denoted by Z is a reference value for determining the variation of the injection quantity $T_a$.

Figure 16:
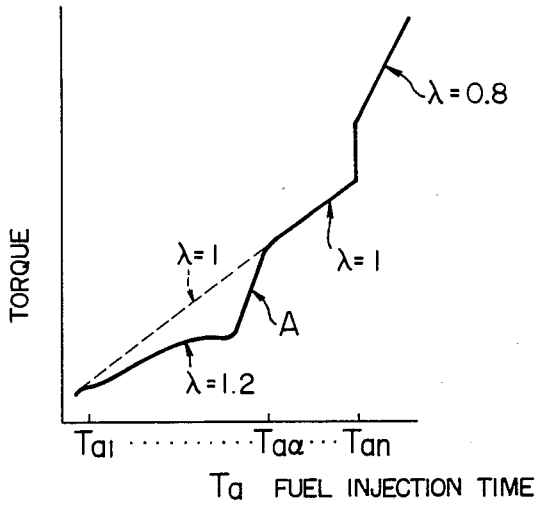
FIG. 16 is a graph showing the relation between the fuel injection time and the engine torque.
Figure 17:
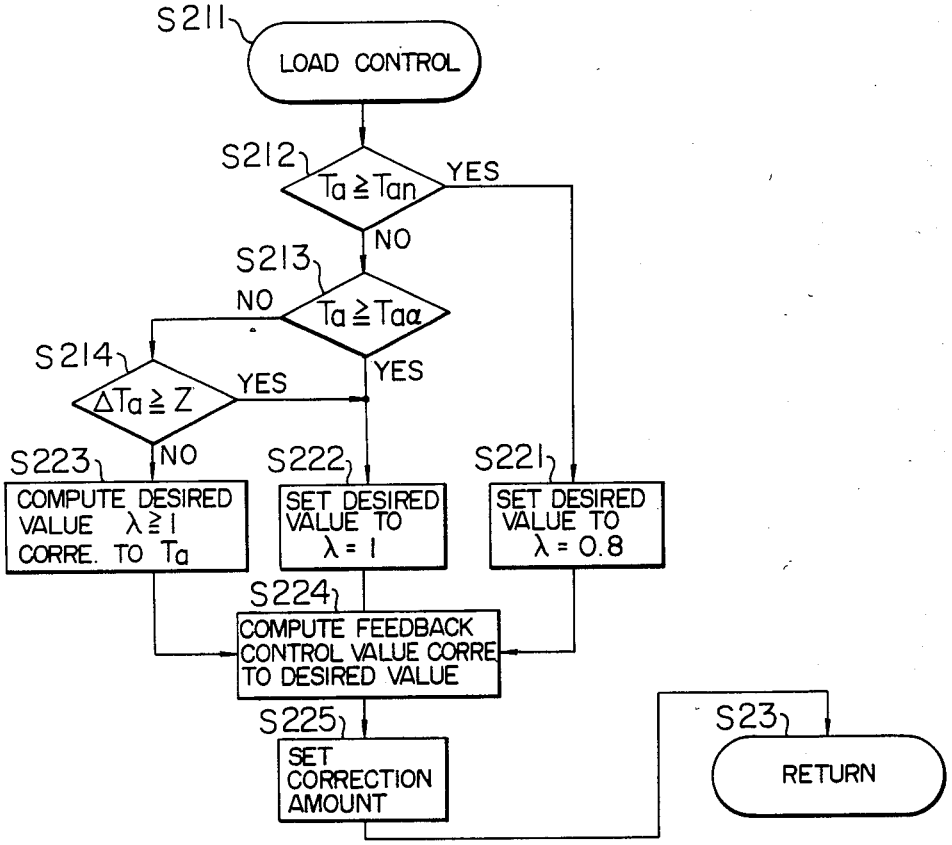
FIG. 17 is a flow chart showing the operation of controlling the air-fuel ratio during a rapid acceleration operation as shown in FIG. 16.

On the other hand, the torque for the acceleration operation may be set as shown by the broken line in FIG. 16. In other words, when it is required to increase the acceleration rate during the operation, the air-fuel ratio can be controlled in such a manner that the torque is increased with a steep slope as shown by the arrow A. A detailed flow chart for this purpose is shown in FIG. 17. In the Figure, when it is determined at a step S214 that the rate of change $\Delta T_a$ of the injection quantity $T_a$ is greater than the rate of change Z, i.e., when the acceleration rate is great (step S214), the desired value is set to $\lambda=1$ even if the injection quantity $T_a$ is in the low region. On the contrary, when the value of $T_a$ is in the high region, the desired value is set to $\lambda<1$. While, in the case of FIG. 5, the desired value is set to $\lambda=0.8$, the setting of $\lambda$ may be made in a stepwise or continuous manner between 1 and 0.8 in accordance with the values of $T_a$. Also, when the atmospheric pressure decreases, the maximum value of the basic injection quantity for the engine decreases and the region of $\lambda<1$ is decreased. In this case, it is possible to change the value of $T_{an}$ at which the change from $\lambda=1$ to $\lambda<1$ is made in accordance with the atmospheric pressure. If the engine is equipped with a turbosupercharger, the maximum value of Ta increases and therefore the values of $T_{an}$ and $T_{a\alpha}$ can be increased. Here, the value of $\Delta T_a$ is related to the weight of the vehicle.

Also, the desired drivability can be ensured by varying the values of $T_{an}$ and $T_{a\alpha}$ in accordance with the vehicle weight. Then, the displacement of the suspension spring is measured to determine the weight so that if the weight is small, the value of $T_{a\alpha}$ is increased to increase the driving region of $\lambda>1$ and the air-fuel ratio is controlled to improve the fuel economy. If the weight is large, the value of $T_{a\alpha}$ is decreased to decrease the driving region of $\lambda>1$ and the air-fuel ratio is controlled to ensure the desired acceleration performance.

Figure 18:
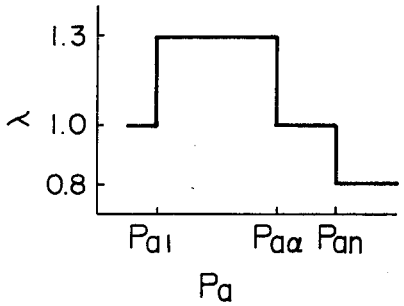
FIGS. 18 and 19 are graphs showing respectively the relation between the intake load Pa and the desired value λ and the relation between the time and the desired value λ.
Figure 19:
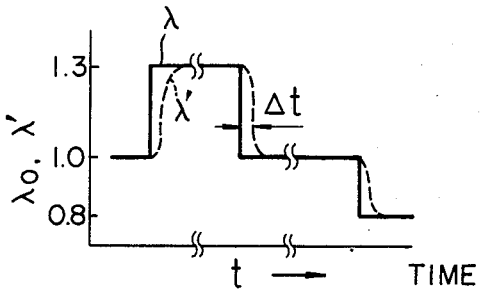

On the other hand, where the closed-loop control is effected in all the regions of $\lambda>1, \lambda=1$ and $\lambda<1$, if the desired value $\lambda$ is set in relation to the intake load $P_a$ as shown in the graph of FIG. 18, the value of $\lambda$ varies with the lapsed time t at shown in FIG. 19 and a delay time $\Delta t$ is caused. Also, the signal from the air-fuel ratio sensor 7 is delayed as the broken line values of $\lambda'$ in FIG. 19 due to the flow delay in the exhaust system (this delay depends on the distance from the cylinder exhaust port to the sensor 7) and so on. Thus, in the case of the closed-loop control, if this delay is not taken into consideration, a change in the desired value of $\lambda_0$ causes an erroneous operation.

Figure 20:
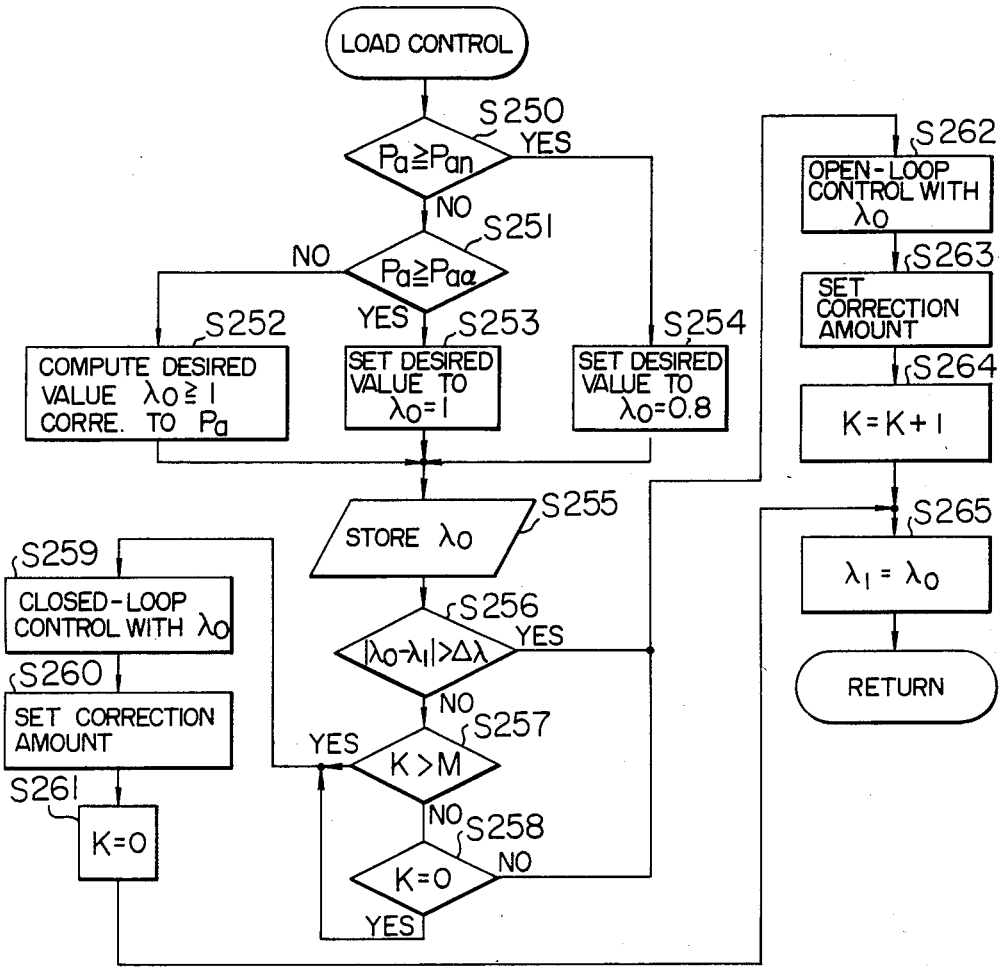
FIGS. 20 and 21 are flow charts showing respectively the operation of controlling the air-fuel ratio in consideration of the delay characteristic of an air-fuel ratio sensor.
Figure 21:
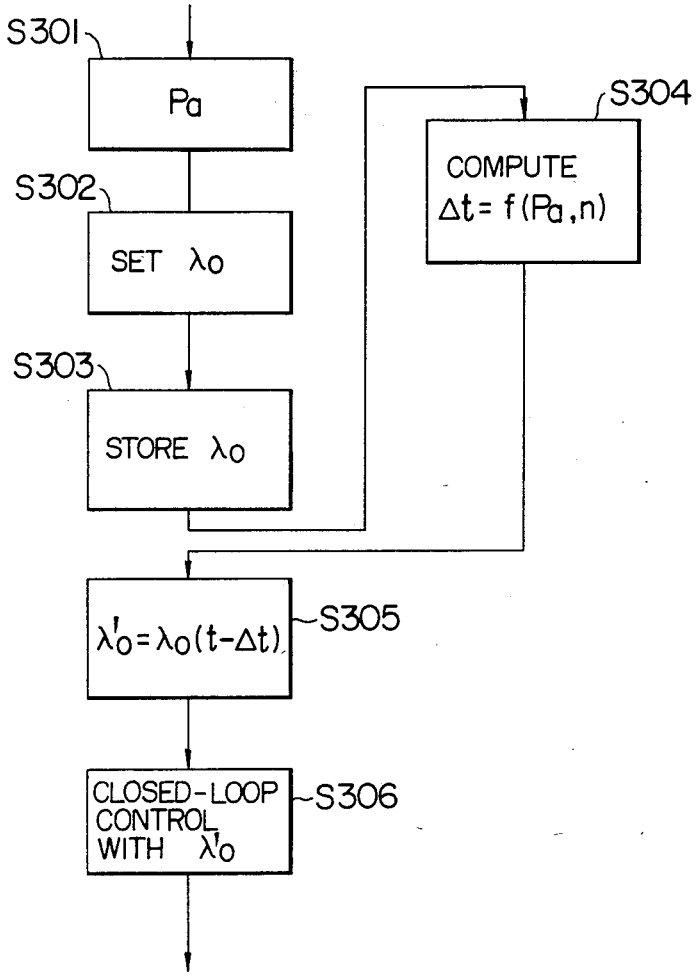

FIGS. 20 and 21 show flow charts for preventing any erroneous operation due to the delay of the air-fuel ratio sensor 7.

In FIG. 20, the desired value $\lambda_0$ is determined in accordance with the intake load $P_a$ and it is temporarily stored (step S255). Where the variation of $\lambda_0$ is large (step S256), the open-loop control is effected according to the desired value $\lambda_0$ (step S262). Then, 1 is added to the value of K and the value of $\lambda_1$ is updated. When the variation of the desired value $\lambda_0$ is small and hence the value of K is small (when the value of K is smaller than a given value M corresponding to the delay time $\Delta t$ at a step S258), the open-loop control is also performed (step S262). On the other hand, if the value of K is greater than the value M, the closed-loop control is performed (step S259). In this way, the desired value $\lambda_0$ is temporarily stored and after the expiration of the delay time $\Delta t$ the air-fuel ratio is controlled in accordance with the desired value $\lambda_0$ thereby preventing any erroneous operation due to the signal delay of the air-fuel ratio sensor 7.

In FIG. 21, the desired value $\lambda_0$ is set in accordance with the intake load $P_a$ (step S302) and it is then stored (step S303). Also, the delay time $\Delta t$ is computed in accordance with the pressure $P_a$ and the engine speed n (step S304). Then, in accordance with the set and stored value $\lambda_0$, the value preceeding by the time $\Delta t$ is read out and set as $\lambda_0'$ (step S305). This $\lambda_0$ is used as the desired value and the closed-loop control is effected (step S306). In this way, any erroneous operation due to the signal delay of the air-fuel ratio sensor 7 is prevented.

FIG. 22 shows an embodiment of the air-fuel ratio sensor 7 employed by this invention. The air-fuel ratio sensor 7 is well suited for the closed-loop control of the air-fuel ratio over a wide range from the low load to the high load. In the Figure, electrodes 38*a* and 38*b* arranged on the sides of a solid electrolyte 37 and also provided is a diffusion chamber 40 having an orifice 39 which serves as a gas diffusion resistor. The operating principle is as follows.

When a current $I_s$ is supplied from a power source V in a direction indicated by an arrow, oxygen is discharged into the exhaust gases through the solid electrolyte 37 (the pumping action of the solid electrolyte). Also, oxygen is supplied from the exhaust gases through the orifice 39 into the diffusion chamber 40 by diffusion due to the difference in concentration. Then, when the current $I_s$ is increased, the amount of oxygen discharged by the pumping action is increased and the concentration partial pressure of the oxygen in the diffusion chamber 40 is decreased ($10^{-12}$ atmospheres) thus generating an electromotive force $V_s$ (about 1 V) as in the case of the ordinary oxygen sensor. This relation between the current $I_s$ (limiting current) and the concentration of oxygen in the exhaust gases is well known in the art. Then, if the current supplied to the solid electrolyte 37 is supplied in the reverse direction as a direction of $I_p$, the pumping action of the solid electrolyte 37 acts from the exhaust gases toward the diffusion chamber 40. Assuming that the direction of the current flowing in the direction of $I_p$ is positive and the direction of the current $I_s$ is negative as shown in (A) and (B) of FIG. 23, if the current is supplied in the direction of $I_p$ for a given time, the oxygen concentration of the diffusion chamber 40 becomes greater than that of the exhaust gases. Then, if the current is supplied in the direction of $I_s$, the drop in the concentration of the diffusion chamber 40 is delayed by an amount corresponding to the rise in the concentration of the diffusion chamber 40 provided by $I_p$ and the oxygen concentration of the diffusion chamber 40 comes near to $10^{-12}$ atmosphere. When this occurs, an electromotive force $V_s$ is generated. The current is switched to the direction of $I_p$ by the change of the electromotive force $V_s$. By maintaining constant the current value and duration time of $I_p$, it is possible to supply the oxygen in an amount proportional to the oxygen concentration of the exhaust gases. As a result, if the value of $I_s$ is constant, the duration time of $I_s$ required for generating the electromotive force $V_s$ varies in proportion to the concentration of oxygen in the exhaust gases. In other words, the oxygen concentration of the exhaust gases is proportional to the effective current $\bar{I}_s$ of $I_s$.

FIG. 24 shows a detection characteristic of the air-fuel ratio sensor 7. Where the current $I_p$ is not supplied (shown by the broken line), the desired value $\lambda$ increases from $\lambda=1$ in proportion to the effective current $\bar{I}_s$. Where the current $I_p$ is supplied (the solid line), the effective current $\bar{I}_s$ makes a translation and increases in proportion to the magnitude of $I_p$. This method is capable of the detection with respect to the region of $\lambda<1$. In other words, even in the range of less than $\lambda<1$, the oxygen is remaining in the actual engine exhaust gases and thus it is an easy matter to increase the oxygen partial pressure within the diffusion chamber 40 to $10^{-12}$ or over and thereby interrupt the generation of $V_s$. By so doing, it is possible to measure the air-fuel ratio over a wide range from $\lambda<1$ to $\lambda>1$ of the desired value $\lambda$.

However, this type of sensor utilizing the diffusion resistance of an orifice, porous material or the like tends to undergo changes in characteristics with time due to the dust, etc., in the exhaust gases. The present invention prevents the effect of such changes in characteristics with time by the below-mentioned means. In other words, owing to the properties of the air-fuel ratio sensor 7, its output signal at the point of $\lambda=1$ is not subject to the effect of the aging. Also, conventional $O_2$ sensors of the type which exhibits a switching operation at the point of $\lambda=1$ (e.g., the one disclosed in FIG. 1 of Japanese Laid-Open Patent Application No. 58-48749) are also not subjected to the effect of the aging. Therefore, the closed-loop control with $\lambda=1$ does not undergo the effect of changes in characteristics with time of air-fuel ratio sensor 7.

FIG. 25 is a flow chart showing an example of an anti-aging measure for the air-fuel ratio sensor 7. Referring to (A) of FIG. 25, in the closed-loop control region of $\lambda=1$ shown at a step S320, a correction amount $\Delta T_p$ is computed (step S321) so that an injection pulse width $T_p$ is computed as $T_p=T_{p0}+\Delta T_p$ (step S322) and the injection quantity is corrected to attain $\lambda=1$. Here, $T_{p0}$ represents the basic injection time duration. This injection pulse width $T_p$ is temporarily stored each time a correction is made, for example (step S323). In (B) of FIG. 25, a correction amount $\Delta T_{p2}$ is also computed in the closed-loop control of $\lambda>1$ at a step S325. Thus, the injection pulse width is corrected as $T_{p2}=T_{p20}+\Delta T_{p2}$ (step S326). Where the air-fuel ratio sensor 7 undergoes no changes in characteristics with time, it is foreseen that the relation of $T_{p2}=T_p/\lambda$ is satisfied. Thus, using the value of $T_p$ stored at the step S323, if $\epsilon=|T_{p2}-T_p/\lambda|$ is smaller than an aging reference value $\epsilon_0$ indicating that the aging of the air-fuel ratio sensor 7 is small, the control operation is just continued (step S328). Where $\epsilon > \epsilon_0$ indicating that the aging of the air-fuel ratio sensor 7 is large, the closed-loop controls other than that of $\lambda = 1$ are stopped (step S329). In this case, as shown in (A) of FIG. 26, the value of $T_{p2}$ is computed from $T_{p2} = T_p/\lambda$ at a step S340 and the desired fuel injection quantity is computed on the basis of this value. Since the error has been corrected in the closed-loop control of $\lambda = 1$, the injection quantity computed by this method is alsoaccurate. In the operating regions where the closed-loop control of $\lambda = 1$ is not effected, using the basic injection pulse width $T_{p2} = T_{p20}(T_p/T_{p0})$, the pulse width can be corrected by extrapolating the correction factor $(T_p/T_{p0})$ of the closed-loop control region (step S341).

Also, in the closed-loop control system, where the fuel injection quantity is controlled according to $T_{p2} = T_p/\lambda$(step S342) as shown in (B) of FIG. 26, if the signal from the air-fuel ratio sensor 7 shows the actual measured value with respect to the desired value $\lambda$, then $\lambda' = k\lambda$ results (step S343). Here, k is an error constant. The value of k can be obtained from the actual output signal $\lambda'$ of the sensor 7 and the desired value $\lambda$(step S344). By making a correction of $\lambda_2 = \lambda'/k$ to the output signal $\lambda'$ of the sensor 7 (step S345) or by effecting the closed-loop control by using the value of $\lambda_2$, it is possible to avoid the effect of the aging of the air-fuel ratio sensor 7. In FIG. 25, the value of k can be obtained from $k = T_{p2} \cdot \lambda / T_p$ by using the closed-loop control value $T_{p2}$.

The heretofore disclosed control or a so-called learning control of obtaining the value of $T_{p2}$ from $T_{p2} = Ta/\lambda$ by using the stored value $T_p$ of the feedback control is susceptible to the effect of the hysteresis, etc., of the injection valve. On the other hand, the closed-loop control of the air-fuel ratio sensor 7 is susceptible to the effect of the aging of the air-fuel ratio sensor 7, although it can avoid the effect of the hysteresis. In accordance with the present invention, the leaning control and the closed-loop control are effectively combined thus making it possible to properly set the value of $\lambda$ over a wide range of operating conditions. The essential points and effects of the present embodiment may be summarized as follows.

(a) Since the closed-loop control is effected not only in the operating regions of $\lambda > 1$ and $\lambda = 1$ but also in the region of $\lambda < 1$, the fuel consumption is reduced during the starting and warm-up operation and the high load and speed operation.

(b) Since the proper setting of $\lambda$ under the operating conditions is ensured, the reduced fuel consumption and the improved exhaust purification and drivability are accomplished simultaneously.

(c) Since the closed-loop control is effected by taking the delay of the air-fuel ratio sensor into consideration, even if the value of $\lambda$ is varied from moment to moment, the value of $\lambda$ is properly followed up in accordance with its desired value so that the deviation from the desired value of $\lambda$ is reduced and the capacity of the catalyst is reduced.

(d) Since the leaning control and the closed-loop control are combined effectively, the changes in characteristics with time are reduced and both the reduced fuel consumption and the improved exhaust gas purification and drivability are maintained over a long distance of travel.

While, in the embodiment of FIG. 1, the invention is applied to the injection system equipped engine the invention is also applicable to carburetor equipped engines. Further, the setting of $\lambda$ can be made as desired by a bypass air valve. Still further, the air-fuel ratio sensor is not limited to the embodiment of FIG. 22 and it may be of any other type such as the one disclosed for example in Japanese Laid-Open Patent Application No. 58-48749 in which the value of $\lambda$ is obtained by switching.

From the foregoing description it will be seen that the present invention is capable of ensuring a reduced fuel consumption under light load conditions and an increased power output under high load conditions.

Although the invention has been described in its preferred form with a certain degree of particularity, it is understood that the present disclosure of the preferred form has been changed in the details of construction, and the combination and arrangement of parts may be modified without departing from the spirit and the scope of the invention as hereinafter claimed.

What is claimed is:

1. An air-fuel ratio control apparatus for internal combustion engines comprising:
   - a sensor for detecting an intake air flow to an engine;
   - an engine rotational speed sensor;
   - an air-fuel ratio sensor for detecting an amount of oxygen over a wide range of operating conditions from a light load operation to a high load operation of said engine;
   - a cooling water temperature sensor;
   - throttle valve control means;
   - fuel supply means;
   - ignition means, and
   - a control signal generating circuit for receiving signals from said intake air flow sensor, said rotational speed sensor, said cooling water temperature sensor and said air-fuel ratio sensor to process said signals in accordance with a predetermined program and generate control signals for controlling said throttle valve control means, said fuel supply means and said ignition means,
   - whereby a desired air-fuel ratio is set in such a manner that an air-fuel ratio ($\lambda$) in a light-load, intermediate-load or high-load operating region of said engine becomes $\lambda > 1$, $\lambda = 1$ or $\lambda < 1$, respectively, and an output of said air-fuel ratio sensor is utilized to make a feedback control such that said desired air-fuel ratio is maintained in each corresponding one of said operating regions.

2. An apparatus according to clain 1, wherein said desired air-fuel ratio is corrected by utilizing an output from said cooling water temperature sensor.

3. An apparatus according to claim 1, further comprising a gear ratio sensor for generating a signal corresponding to a gear ratio of a gear transmission whereby said desired air-fuel ratio is corrected by utilizing an output from said gear ratio sensor.

4. An apparatus according to claim 1, further comprising a temperature sensor for detecting a temperature of an exhaust gas whereby said desired air-fuel ratio is corrected by utilizing an output from said temperature sensor.

5. An apparatus according to claim 1, wherein a torque characteristic of said engine is provided with a hysteresis characteristic (H1, H2) with respect to the quantity of fuel supplied whereby said air-fuel ratio is changed smoothly in said air-fuel ratio feedback control.

6. An apparatus according to claim 1, wherein a change in the quantity of fuel supplied indicating an acceleration (A) of a vehicle equipped with said engine is utilized so as to change said air-fuel ratio smoothly in accordance with a weight of said vehicle.

7. An apparatus according to claim 1, further comprising means for storing a delay characteristic ($\Delta t$) of said air-fuel ratio sensor whereby said desired air-fuel ratio is corrected by utilizing said delay characteristic stored in said storage means.

8. An apparatus according to claim 1, wherein said desired air-fuel ratio is corrected by utilizing an error ($\epsilon$) of a detection output signal due to an aging of said air-fuel ratio sensor.

9. An apparatus according to claim 2, further comprising a gear ratio sensor for generating a signal corresponding to a gear ratio of a gear transmission whereby said desired air-fuel ratio is corrected by utilizing an output from said gear ratio sensor.

10. An apparatus according to claim 9, further comprising a temperature sensor for detecting a temperature of an exhaust gas whereby said desired air-fuel ratio is corrected by utilizing an output from said temperature sensor.

11. An apparatus according to claim 10, wherein a torque characteristic of said engine is provided with a hysteresis characteristic with respect to the quantity of fuel supplied, whereby said air-fuel ratio is changed smoothly in said air-fuel ratio feedback control.

12. An apparatus according to claim 11, wherein a change in the quantity of fuel supplied indicating an acceleration of a vehicle equipped with said engine is utilized so as to change said air-fuel ratio smoothly in accordance with a weight of said vehicle.

13. An apparatus according to claim 12, further comprising means for storing a delay characteristic of said air-fuel ratio sensor, whereby said desired air-fuel ratio is corrected by utilizing said delay characteristic stored in said storage means.

14. An apparatus according to claim 13, wherein said desired air-fuel ratio is corrected by utilizing an error of a detection output signal due to said air-fuel ratio sensor.

* * * * *